US007761937B2

(12) United States Patent
Foutz et al.

(10) Patent No.: US 7,761,937 B2
(45) Date of Patent: Jul. 27, 2010

(54) TIMEPIECE SHOWER HEAD

(76) Inventors: Gregory J. Foutz, 1828 Concord Ave., Stockton, CA (US) 95204; Angela A. Wright, 1828 Concord Ave., Stockton, CA (US) 95204; Tarek A. Bawab, 1901 Winding oak, Lodi, CA (US) 95242

( * ) Notice: Subject to any disclaimer, the term of this patent is extended or adjusted under 35 U.S.C. 154(b) by 227 days.

(21) Appl. No.: 12/220,128

(22) Filed: Jul. 22, 2008

(65) Prior Publication Data

US 2009/0031492 A1 Feb. 5, 2009

Related U.S. Application Data

(60) Provisional application No. 60/963,033, filed on Aug. 1, 2007.

(51) Int. Cl.
*A47K 3/28* (2006.01)

(52) U.S. Cl. ..... 4/597; 4/605; 4/661; 239/289; 239/71

(58) Field of Classification Search ..... 4/597, 4/605, 615, 559, 675, 678, 567, 616–618; 137/551, 552.7; 239/289, 70, 71
See application file for complete search history.

(56) References Cited

U.S. PATENT DOCUMENTS

| | | | | |
|---|---|---|---|---|
| 2,545,928 | A | 3/1951 | Martin | |
| 4,345,621 | A | 8/1982 | Dunckhorst | |
| 4,944,049 | A | 7/1990 | Leonard | |
| 5,260,918 | A | 11/1993 | Neustein | |
| 5,779,146 | A * | 7/1998 | Cutler | 239/71 |
| 5,940,350 | A * | 8/1999 | Booty, Jr. | 368/276 |
| 6,182,910 | B1 * | 2/2001 | Huen | 239/289 |
| 6,823,536 | B2 * | 11/2004 | Yip | 4/615 |
| 2006/0283973 | A1 * | 12/2006 | Bean | 239/70 |
| 2009/0106891 | A1 * | 4/2009 | Klicpera | 4/605 |

* cited by examiner

*Primary Examiner*—Gregory L Huson
*Assistant Examiner*—Janie Christiansen
(74) *Attorney, Agent, or Firm*—Randal Homburg

(57) ABSTRACT

A modified shower head provides a timepiece imbedded within a shower head insert allowing a person showering to keep track of time and also to monitor water usage. It also provides the person showering with a timing mechanism to determine the length of time for use of hair products, tints, dyes and treatments without having to reference an outside timepiece. The insert comprises a timepiece within an encased water-proof enclosure within the shower head insert.

8 Claims, 3 Drawing Sheets

TIMEPIECE SHOWER HEAD

CROSS REFERENCE TO RELATED APPLICATIONS

Applicant claims the benefit of Provisional Patent Application No. 60/963,033 filed on Aug. 1, 2007 by the same inventors.

BACKGROUND OF THE INVENTION

1. Field of Invention

A modified shower head provides a timepiece imbedded within a shower head insert allowing a person showering to keep track of time and also to monitor water usage. It also provides the person showering with a timing mechanism to determine the length of time for use of hair products, tints, dyes and treatments without having to reference an outside timepiece. The insert comprises a timepiece within an encased water-proof enclosure.

2. Description of Prior Art

The following United States patents were discovered and are disclosed within this application for utility patent. All relate to mechanisms which incorporate timed apparatus within a shower delivery system.

Two patents describe devices that control the flow of water with a timed shutoff means. In U.S. Pat. No. 2,545,928 to Martin, the automatic water shutoff device has a timer which closes a mechanical valve after a set period of time has expired. It does not tell time, but could, since it embodies a clock face. A similar device is disclosed in U.S. Pat. No. 4,345,621 to Dunckhorst, except it is specifically adapted to a shower head having a rotary dial to set the time of water flow. It does not tell time.

Most closely similar is a combination timepiece shower head, U.S. Pat. No. 4,944,049 to Leonard, with the first several claims dealing with the aspects of the mechanical shower head with a clock within a housing. The last eight claims deal with the shower apparatus having an electronic clock, a digital clock, a display of real time in digital form, a real time/elapsed time combination display, a battery operation, and a switching means for the clock. It is basically a replacement shower head replacing the conventional shower head without a timepiece. It does not disclose the housing as related to the clock, except for a cursory mention in column 3 lines 51-68, with any specific detail, other than to state that "the clock display . . . is mounted in housing . . . and is completely sealed from water contamination.", lines 62-64.

A simple hourglass timer which attaches to a shower wall is disclosed in U.S. Pat. No. 5,260,918. Several other patents of this nature were also discovered which provide a simple waterproof clock for use in the shower or bath. However, none of them provide any reference which would indicate same or similar elements as would be found in the present device.

SUMMARY OF THE INVENTION

Shower head have been in use for years. Typically, these shower head comprise a shower head cone with an insert for adjusting the water flow and spray patterns of the shower head. While these devices are suitable for their intended purposes, they are not suitable for the placement of an interchangeable plug with a functional clock face and a selection of decorative backgrounds. It would be desirable if the ordinary shower head would include an interchangeable functional clock and a decorative background to blend with the colors and decor of the bathroom and shower or to suit the chosen taste of the user.

In this regard, the present timepiece shower head replaces a traditional insert of a shower head with a waterproof timepiece having a selected background, serving a function of still adjusting the flow and spray pattern of the shower head, but also providing a timepiece for the user to tell time, determine the passage of time and also to set an alarm of an alert when a given amount of time has elapsed to conserve water and to prevent too much time being spent in the shower.

The primary objective of the invention is to provide a shower head having an interchangeable plug insert including a clock and a background scene or icon. A second objective is to provide the shower head with the ability to inform a user of the current time, preventing people from being late, from using too much water or for use with timed hair and hygiene treatments. A third objective is to provide the insert with a different aesthetic appearance to suit the taste of the user. A fourth objective is to provide the plug insert as a means of conserving water usage or to allot the amount of time each user spends where a large number of occupants reside within a single household. A fifth advantage lies with a parents ability to train a child to take an appropriate amount of time in the shower. Other advantages may be realized may be obvious to a user which would be obvious to those users within the scope of this improved shower head insert.

DESCRIPTION OF THE DRAWINGS

The following drawings are submitted with this utility patent application.

DESCRIPTION OF THE PREFERRED EMBODIMENT

Figure 1:
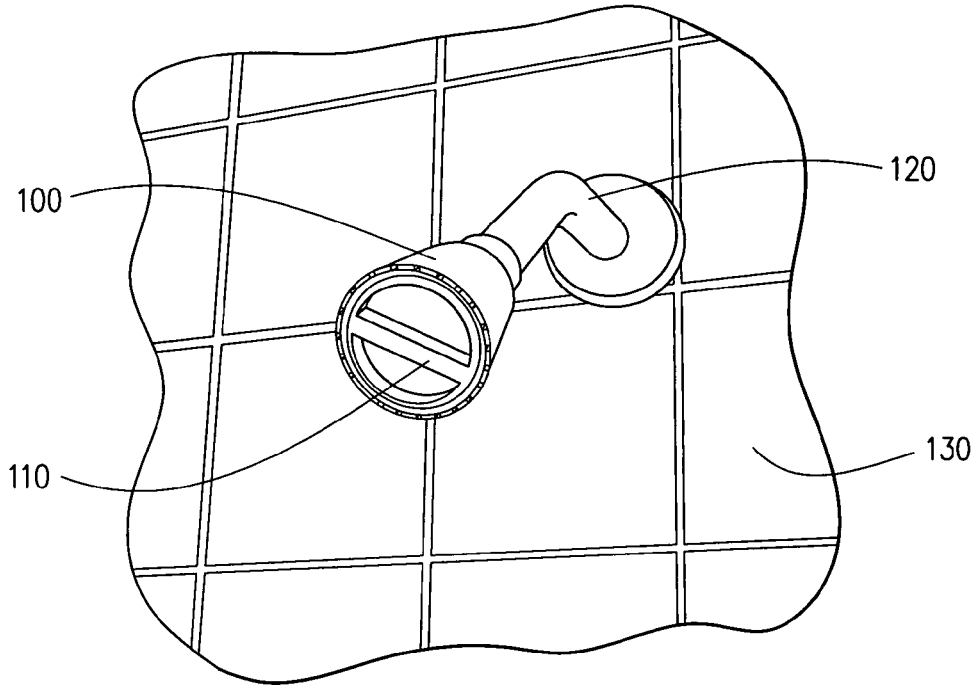
FIG. 1 PRIOR ART
FIG. 1 is a representation of the prior art shower head.
Figure 2:
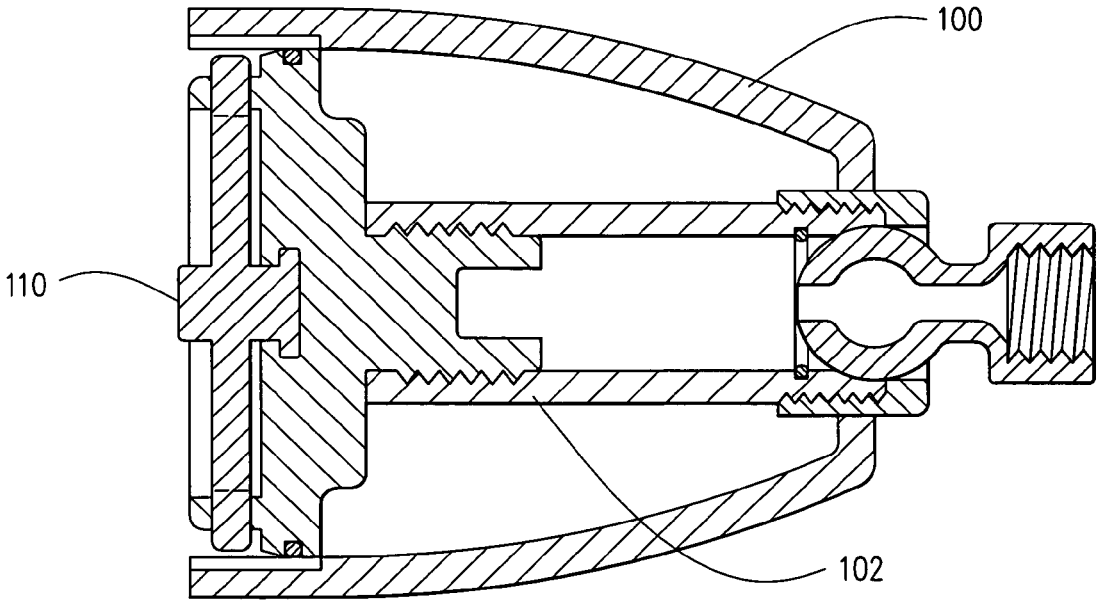
FIG. 2 PRIOR ART
FIG. 2 is a cross-sectional view of the prior art shower head.
Figure 3:
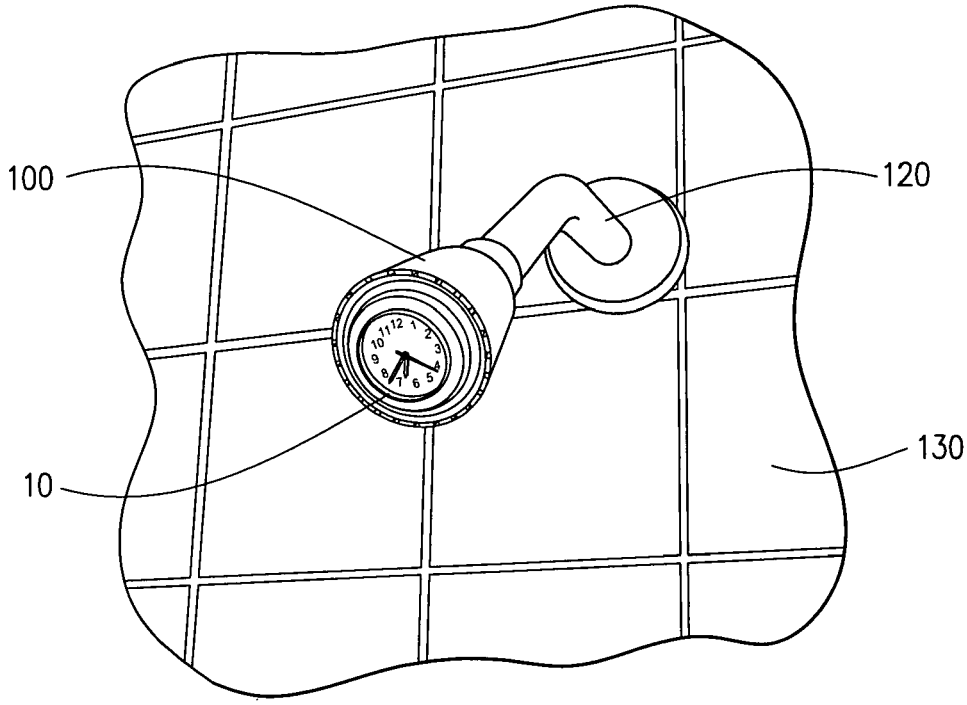
FIG. 3 is a front view of the improved shower head with the interchangeable waterproof timepiece insert installed.
Figure 4:
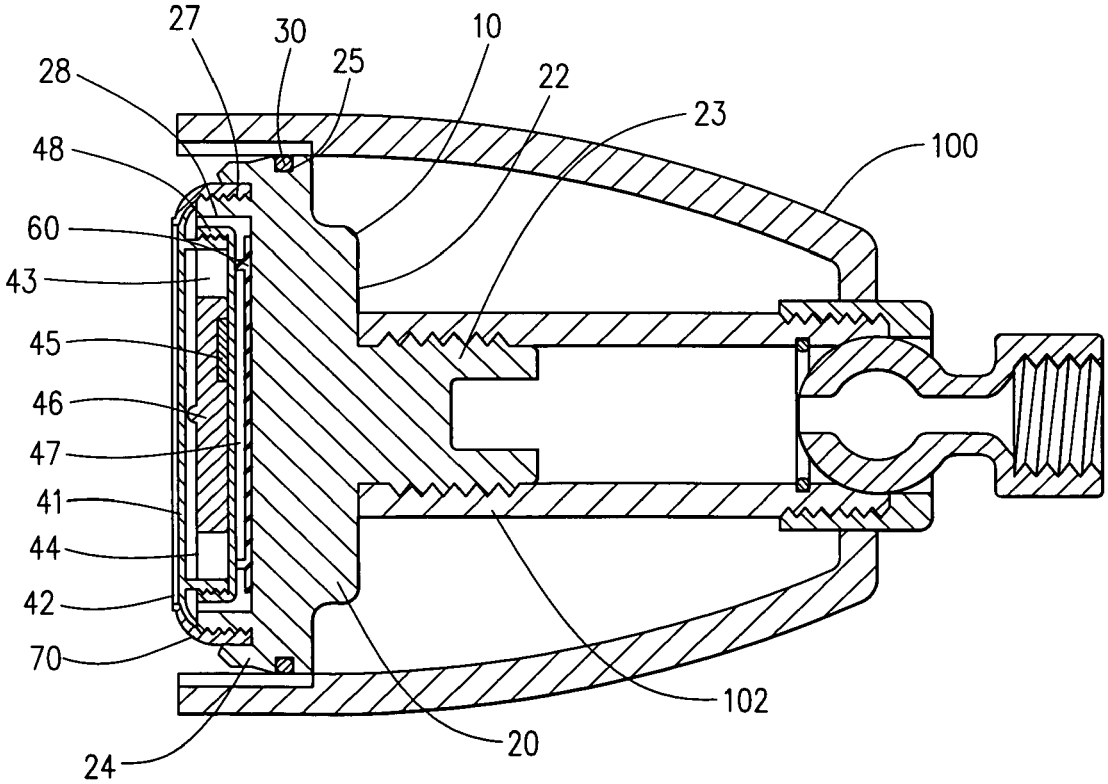
FIG. 4 is a cross sectional view of the improved shower head with the timepiece insert.
Figure 5:
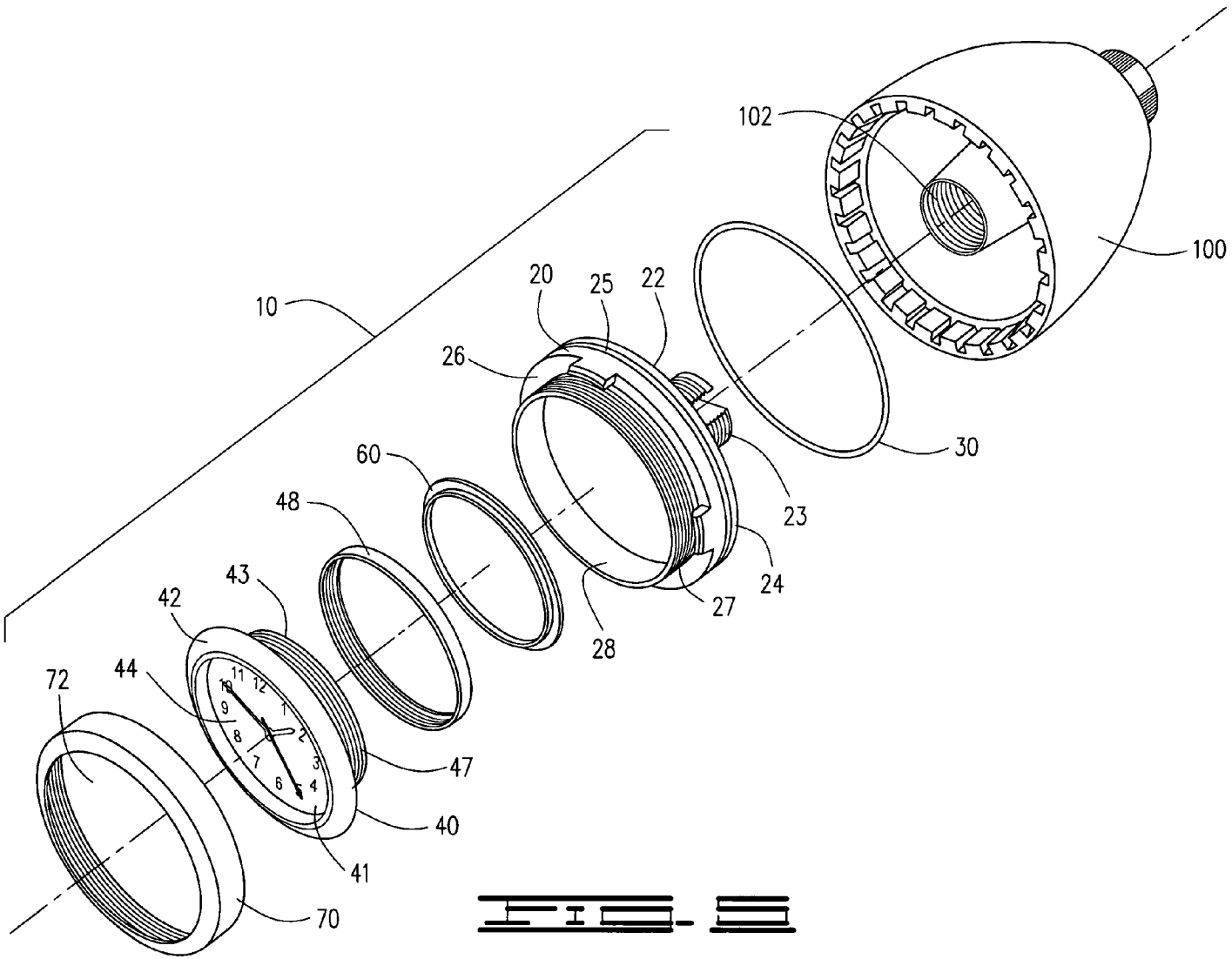
FIG. 5 is an expanded view of the components of the interchangeable waterproof timepiece insert and the shower head cone.

An improvement to shower head providing an interchangeable waterproof timepiece member 10 to replace a shower cone regulator insert 110 within a shower head cone 100 pivotally and rotatably attached to a shower pipe stem 120 emanating from a wall 130 within a shower or bath, FIGS. 1-2, the improvement, shown in FIGS. 4-5, comprising the interchangeable waterproof timepiece member 10 defining a shower piece insert 20 having an externally threaded nipple 23 on a rear surface 22 inserted into an internally threaded female receiver 102 within the shower head cone 100, the shower piece insert 20 further defining an outer perimeter elevation 24 having an O-ring groove 25 for the insertion of an O-ring 30 and a front surface 26 defining an externally threaded rim 27 and an inner cavity 28, the inner cavity 28 containing a sealed timepiece 40 with an ornamental background 44, a rubber seal washer 60 maintaining a waterproof compression seal between the sealed timepiece 40 and the inner cavity 28 and an internally threaded outer seal ring 70 having an open timepiece display orifice 72, retaining an outer portion 42 of the sealed timepiece 40 within the inner cavity 28. The sealed timepiece 40 further comprises a clock face 41, either digital or analog, an inner chamber 43 wherein a low voltage power supply 45 operates a clockwork assembly 46 and a waterproof seal cap 48 on a rear portion 47 of the sealed timepiece 40 forming a watertight seal to the sealed timepiece 40.

The externally threaded nipple 23 of the shower piece insert 20, being easily removed from the internally threaded female receiver 102 of the shower cone 100, allows for the removal of the interchangeable waterproof timepiece member 10 to gain access to and change the sealed timepiece 40 or open the waterproof seal cap 48 to gain access to the clockwork assembly 46 to change the time or the change the low voltage power supply 45 when spent. In other embodiments, the externally threaded nipple 23 may be replaced by another form or generic connecting means that would allow the shower piece insert to be connected within the shower cone as a substitute for the existing cone regulator insert 110. However, the other structures would remain consistent.

The interchangeable waterproof timepiece member 10 may be made from many selected materials, but it would be best if the shower piece insert 20 was made of a similar material or a durable metal or plastic as the shower cone regulator insert 110 being replaced, rigid and non-deformable, especially since the interchangeable waterproof timepiece member 10 would be under pressure from the water. The O-ring 30 would preferably be a flexible rubber, compressible to form a tight seal between the shower piece insert 20 and the shower head cone 100 to allow a controlled flow similar to the shower cone regulator insert 110 being replace to maintain the function of the original shower head. The rubber seal washer 60 should also tightly conform to the sealed timepiece 40 and be deformable allowing the sealed timepiece 40 to be compressed within the inner cavity 28 and retained without movement once the internally threaded outer seal ring 70 is applied to the externally threaded rim 27 of the shower piece insert 20. The internally threaded outer seal ring 70 may be made of metal, plastic or other non-deformable rigid material with a finish to complement the shower head cone 100 and the sealed timepiece 40 framed within the timepiece display orifice 72.

The sealed timepiece 40 may also provide an alarm which may be set for a chosen length of time, a mode selection button to select between real time and a timed chronometer, and a switch to activate and deactivate the alarm setting and to set the clock for use in the user's time zone location, if it would be more convenient to leave the sealed timepiece in the inner cavity to change the timepiece settings. The alarm may be provided by a buzz or a small audio loop which would be programmed into a timepiece sound module, which may be related to the ornamental background 44. By example, if the ornamental background 44 were a sports insignia, the alarm may be provided as a sound loop for that particular team song. As another example, although not suggesting use without the appropriate license, if a cartoon character were provided in the ornamental background 44, a song associated with that cartoon character might be appropriate. Although not necessarily shown in the drawings, these timepiece features already exist in the prior art and are not within themselves novel, but may be incorporated within the sealed timepiece 40.

The sealed timepiece 40 may also include as an accessory, not shown but contemplated within the scope of this shower head insert where new technologies may apply, a video screen or a small radio. It is also contemplated that a recharging means, not shown, may also be included using the water flow associated with the shower head, to recharge the internal low voltage power supply 45, with a type of water wheel generation system.

While the improvement has been particularly shown and described with reference to a preferred embodiment thereof, it will be understood by those skilled in the art that changes in form and detail may be made therein without departing from the spirit and scope of the disclosed interchangeable waterproof timepiece member 10. Further, the foregoing disclosure is considered illustrative only of the principles of a shower piece insert 20 and may be modified to suit other shower heads of any shape or form. The shower head insert 20 may be presented in a form which would replace the cone regulator insert 110 in any shower head and thus define any connecting structures or connecting means 23 that would allow for the improvement to be substituted for the currently manufactured shower cone insert 100. Further, since numerous modifications and changes will occur with those skilled in the art, if is not the intent of this disclosure to limit the improvement to the exact construction and operation shown a described. Thus and accordingly, all suitable modifications and improvements resorted to may be considered within the scope of this improvement to any conventional shower head.

We claim:

1. An improvement to shower heads providing an interchangeable waterproof timepiece member for replacing a shower cone regulator insert within a shower head cone which is pivotally and rotatably attached to a shower pipe stem emanating from a wall within a shower or bath, said improvement comprising:

an interchangeable waterproof timepiece member defining a shower piece insert having a connecting means on a rear surface attached within said shower head cone as was the original shower cone regulator insert being replaced, an outer perimeter elevation having an O-ring groove for insertion of an O-ring, an O-ring, and a front surface defining an externally threaded rim and an inner cavity, said inner cavity containing a sealed timepiece with an ornamental background, a rubber seal washer maintaining a waterproof compression seal between said sealed timepiece and said inner cavity and an internally threaded outer seal ring having an open timepiece display orifice, retaining an outer portion of said sealed timepiece within said inner cavity.

2. The improvement, as disclosed in claim 1, said sealed timepiece further comprising:

a clock face, either digital or analog, an inner chamber wherein a low voltage power supply operates a clockwork assembly, and a waterproof seal cap on a rear portion of said sealed timepiece forming a watertight seal to said sealed timepiece.

3. The improvement, as disclosed in claim 1, further comprising:

said O-ring is made from flexible rubber, compressible to form a tight seal between said shower piece insert and said shower cone to allow a controlled flow of water around said O-ring, similar to said shower cone regulator insert being replaced, to maintain the same showering function as the original shower head;

said rubber seal washer tightly conforming to said sealed timepiece and deformable allowing said sealed timepiece to be compressed within said inner cavity and retained without movement once said internally threaded outer seal ring is applied to said externally threaded rim of said shower piece insert.

4. The improvement, as disclosed in claim 1, further comprising:

said O-ring is made from flexible rubber, compressible to form a tight seal between said shower piece insert and said shower cone to allow a controlled flow of water around said O-ring, similar to said shower cone regulator insert being replaced, to maintain the same shower function as the original shower head;

said rubber seal washer tightly conforming to said sealed timepiece and deformable allowing said sealed timepiece to be compressed within said inner cavity and retained without movement once said internally threaded outer seal ring is applied to said externally threaded rim of said shower piece insert; and said sealed timepiece further comprising a clock face, either digital or analog, an inner chamber wherein a low voltage power supply operates a clockwork assembly, and a waterproof seal cap on a rear portion of said sealed timepiece forming a watertight seal to said sealed timepiece.

5. An improvement to shower heads providing an interchangeable waterproof timepiece member for replacing a shower cone regulator insert within a shower head cone which is pivotally and rotatably attached to a shower pipe stem emanating from a wall within a shower or bath, the improvement comprising:

an interchangeable waterproof timepiece member defining a shower piece insert having an externally threaded nipple on a rear surface inserted into an internally threaded female receiver within the shower head cone, an outer perimeter elevation having an O-ring groove for insertion of an O-ring, an O-ring, and a front surface defining an externally threaded rim and an inner cavity, said inner cavity containing a sealed timepiece with an ornamental background, a rubber seal washer maintaining a waterproof compression seal between said sealed timepiece and said inner cavity and an internally threaded outer seal ring having an open timepiece display orifice, retaining an outer portion of said sealed timepiece within said inner cavity.

6. The improvement, as disclosed in claim 5, said sealed timepiece further comprising:

a clock face, either digital or analog, an inner chamber wherein a low voltage power supply operates a clockwork assembly, and a waterproof seal cap on a rear portion of said sealed timepiece forming a watertight seal to said sealed timepiece.

7. The improvement, as disclosed in claim 5, further comprising:

said O-ring is made from flexible rubber, compressible to form a tight seal between said shower piece insert and said shower cone to allow a controlled flow of water around said O-ring, similar to said shower cone regulator insert being replaced, to maintain the same shower function as the original shower head;

said rubber seal washer tightly conforming to said sealed timepiece and deformable allowing said sealed timepiece to be compressed within said inner cavity and retained without movement once said internally threaded outer seal ring is applied to said externally threaded rim of said shower piece insert.

8. The improvement, as disclosed in claim 5, further comprising:

said O-ring is made from flexible rubber, compressible to form a tight seal between said shower piece insert and said shower cone to allow a controlled flow of water around said O-ring, similar to said shower cone regulator insert being replaced, to maintain the same shower function as the original shower head;

said rubber seal washer tightly conforming to said sealed timepiece and deformable allowing said sealed timepiece to be compressed within said inner cavity and retained without movement once said internally threaded outer seal ring is applied to said externally threaded rim of said shower piece insert; and said sealed timepiece further comprising a clock face, either digital or analog, an inner chamber wherein a low voltage power supply operates a clockwork assembly, and a waterproof seal cap on a rear portion of said sealed timepiece forming a watertight seal to said sealed timepiece.

* * * * *